US010510483B2

(12) United States Patent
Mino

(10) Patent No.: US 10,510,483 B2
(45) **Date of Patent: *Dec. 17, 2019**

(54) PRODUCTION METHOD FOR R-T-B SINTERED MAGNET

(71) Applicant: HITACHI METALS, LTD., Minato-ku, Tokyo (JP)

(72) Inventor: Shuji Mino, Mishima-gun (JP)

(73) Assignee: HITACHI METALS, LTD., Tokyo (JP)

( * ) Notice: Subject to any disclaimer, the term of this patent is extended or adjusted under 35 U.S.C. 154(b) by 270 days.

This patent is subject to a terminal disclaimer.

(21) Appl. No.: 15/509,528

(22) PCT Filed: Sep. 8, 2015

(86) PCT No.: PCT/JP2015/075503

§ 371 (c)(1),
(2) Date: Mar. 8, 2017

(87) PCT Pub. No.: WO2016/039352

PCT Pub. Date: Mar. 17, 2016

(65) Prior Publication Data

US 2017/0263380 A1 Sep. 14, 2017

(30) Foreign Application Priority Data

Sep. 11, 2014 (JP) ..... 2014-185263
Sep. 11, 2014 (JP) ..... 2014-185265

(51) Int. Cl.
*H01F 41/02* (2006.01)
*B22F 3/10* (2006.01)
(Continued)

(52) U.S. Cl.
CPC ..... *H01F 41/0293* (2013.01); *B22F 1/0003* (2013.01); *B22F 3/1017* (2013.01);
(Continued)

(58) Field of Classification Search
None
See application file for complete search history.

(56) References Cited

U.S. PATENT DOCUMENTS

2007/0240789 A1* 10/2007 Nakamura ..... H01F 41/0293 148/101
2009/0226339 A1 9/2009 Nakamura et al.
(Continued)

FOREIGN PATENT DOCUMENTS

CN 106415752 A 2/2017
EP 1 923 893 A1 5/2008
(Continued)

*Primary Examiner* — Xiaowei Su
(74) *Attorney, Agent, or Firm* — Keating & Bennett, LLP

(57) ABSTRACT

A step of, while a powder of an RLM alloy (where RL is Nd and/or Pr; M is one or more elements selected from among Cu, Fe, Ga, Co, Ni and Al) and a powder of an RH compound (where RH is Dy and/or Tb; and the RH compound is one, or two or more, selected from among an RH fluoride, an RH oxide, and an RH oxyfluoride) are present on the surface of a sintered R-T-B based magnet, performing a heat treatment at a sintering temperature of the sintered R-T-B based magnet or lower is included. The RLM alloy contains RL in an amount of 65 at % or more, and the melting point of the RLM alloy is equal to or less than the temperature of the heat treatment. The heat treatment is performed while the RLM alloy powder and the RH compound powder are present on the surface of the sintered R-T-B based magnet at a mass ratio of RLM alloy:RH compound=9.6:0.4 to 5:5.

3 Claims, 2 Drawing Sheets

(51) Int. Cl.

| | |
|---|---|
| ***B22F 3/24*** | (2006.01) |
| ***B22F 7/02*** | (2006.01) |
| ***H01F 1/057*** | (2006.01) |
| ***C22C 28/00*** | (2006.01) |
| ***C22C 33/02*** | (2006.01) |
| ***H01F 1/08*** | (2006.01) |
| ***B22F 1/00*** | (2006.01) |
| ***C21D 9/00*** | (2006.01) |
| ***C22C 38/00*** | (2006.01) |
| ***C22C 38/06*** | (2006.01) |
| ***C22C 38/10*** | (2006.01) |
| ***C22C 38/16*** | (2006.01) |
| ***C23C 10/30*** | (2006.01) |
| ***B22F 3/26*** | (2006.01) |
| *B22F 5/00* | (2006.01) |

(52) U.S. Cl.

CPC ..... *B22F 3/24* (2013.01); *B22F 3/26* (2013.01); *B22F 7/02* (2013.01); *C21D 9/0068* (2013.01); *C22C 28/00* (2013.01); *C22C 33/02* (2013.01); *C22C 38/002* (2013.01); *C22C 38/005* (2013.01); *C22C 38/06* (2013.01); *C22C 38/10* (2013.01); *C22C 38/16* (2013.01); *C23C 10/30* (2013.01); *H01F 1/057* (2013.01); *H01F 1/0577* (2013.01); *H01F 1/08* (2013.01); *H01F 41/02* (2013.01); *B22F 5/00* (2013.01); *B22F 2003/248* (2013.01); *B22F 2301/355* (2013.01); *B22F 2998/10* (2013.01); *B22F 2999/00* (2013.01); *C22C 38/00* (2013.01); *C22C 2202/02* (2013.01)

(56) References Cited

U.S. PATENT DOCUMENTS

| | | | | |
|---|---|---|---|---|
| 2015/0211139 | A1* | 7/2015 | Nagasaki | C22C 38/002 148/102 |
| 2017/0183765 | A1 | 6/2017 | Mino | |
| 2017/0263379 | A1* | 9/2017 | Mino | C22F 1/16 |
| 2017/0323723 | A1* | 11/2017 | Mino | B22F 3/10 |
| 2017/0330659 | A1* | 11/2017 | Mino | B22F 3/24 |

FOREIGN PATENT DOCUMENTS

| | | | |
|---|---|---|---|
| EP | 1 981 043 | A1 | 10/2008 |
| EP | 3 136 407 | A1 | 3/2017 |
| JP | 2007-287874 | A | 11/2007 |
| JP | 2007-287875 | A | 11/2007 |
| JP | 2012-234971 | A | 11/2012 |
| JP | 2012-248827 | A | 12/2012 |
| JP | 2012-248828 | A | 12/2012 |

* cited by examiner

PRODUCTION METHOD FOR R-T-B SINTERED MAGNET

TECHNICAL FIELD

The present invention relates to a method for producing a sintered R-T-B based magnet containing an $R_2T_{14}B$-type compound as a main phase (where R is a rare-earth element; T is Fe or Fe and Co).

BACKGROUND ART

Sintered R-T-B based magnets whose main phase is an $R_2T_{14}B$-type compound are known as permanent magnets with the highest performance, and are used in voice coil motors (VCM) of hard disk drives, various types of motors such as motors to be mounted in hybrid vehicles, home appliance products, and the like.

Intrinsic coercivity $H_{cJ}$ (hereinafter simply referred to as "$H_{cJ}$") of sintered R-T-B based magnets decreases at high temperatures, thus causing an irreversible flux loss. In order to avoid irreversible flux losses, when used in a motor or the like, they are required to maintain high $H_{cJ}$ even at high temperatures.

It is known that if R in the $R_2T_{14}B$-type compound phase is partially replaced with a heavy rare-earth element RH (Dy, Tb), $H_{cJ}$ of a sintered R-T-B based magnet will increase. In order to achieve high $H_{cJ}$ at high temperature, it is effective to profusely add a heavy rare-earth element RH in the sintered R-T-B based magnet. However, if a light rare-earth element RL (Nd, Pr) that is an R in a sintered R-T-B based magnet is replaced with a heavy rare-earth element RH, $H_{cJ}$ will increase but there is a problem of decreasing remanence $B_r$ (hereinafter simply referred to as "$B_r$"). Furthermore, since heavy rare-earth elements RH are rare natural resources, their use should be cut down.

Accordingly, in recent years, it has been attempted to improve $H_{cJ}$ of a sintered R-T-B based magnet with less of a heavy rare-earth element RH, this being in order not to lower $B_r$. For example, as a method of effectively supplying a heavy rare-earth element RH to a sintered R-T-B based magnet and diffusing it, Patent Documents 1 to 4 disclose methods which perform a heat treatment while a powder mixture of an RH oxide or RH fluoride and any of various metals M, or an alloy containing M, is allowed to exist on the surface of a sintered R-T-B based magnet, thus allowing the RH and M to be efficiently absorbed to the sintered R-T-B based magnet, thereby enhancing $H_{cJ}$ of the sintered R-T-B based magnet.

Patent Document 1 discloses use of a powder mixture of a powder containing M (where M is one, or two or more, selected from among Al, Cu and Zn) and an RH fluoride powder. Patent Document 2 discloses use of a powder of an alloy RTMAH (where M is one, or two or more, selected from among Al, Cu, Zn, In, Si, P, and the like; A is boron or carbon; H is hydrogen), which takes a liquid phase at the heat treatment temperature, and also that a powder mixture of a powder of this alloy and a powder such as RH fluoride may also be used.

Patent Document 3 and Patent Document 4 disclose that, by using a powder mixture including a powder of an RM alloy (where M is one, or two or more, selected from among Al, Si, C, P, Ti, and the like) and a powder of an M1M2 alloy (M1 and M2 are one, or two or more, selected from among Al, Si, C, P, Ti, and the like), and an RH oxide, it is possible to partially reduce the RH oxide with the RM alloy or the M1M2 alloy during the heat treatment, thus allowing more R to be introduced into the magnet.

CITATION LIST

Patent Literature

[Patent Document 1] Japanese Laid-Open Patent Publication No. 2007-287874

[Patent Document 2] Japanese Laid-Open Patent Publication No. 2007-287875

[Patent Document 3] Japanese Laid-Open Patent Publication No. 2012-248827

[Patent Document 4] Japanese Laid-Open Patent Publication No. 2012-248828

SUMMARY OF INVENTION

Technical Problem

The methods described in Patent Documents 1 to 4 deserve attention in that they allow more RH to be diffused into a magnet. However, these methods cannot effectively exploit the RH which is present on the magnet surface in improving $H_{cJ}$, and thus need to be bettered. Especially in Patent Document 3, which utilizes a powder mixture of an RM alloy and an RH oxide, Examples thereof indicate that what is predominant is actually the $H_{cJ}$ improvements that are due to diffusion of the RM alloy, while there is little effect of using an RH oxide, such that the RM alloy presumably does not exhibit much effect of reducing the RH oxide.

An embodiment of the present invention is able to provide a method for producing a sintered R-T-B based magnet with high $H_{cJ}$, by reducing the amount of RH to be present on the magnet surface and yet effectively diffusing it inside the magnet.

Solution to Problem

In one illustrative implementation, a method for producing a sintered R-T-B based magnet according to the present invention includes a step of performing a heat treatment at a sintering temperature of the sintered R-T-B based magnet or lower, while a layer of RLM alloy powder particles (where RL is Nd and/or Pr; M is one or more elements selected from among Cu, Fe, Ga, Co, Ni and Al), which layer is at least one particle thick or greater, and a layer of RH compound powder particles (where RH is Dy and/or Tb; and the RH compound is one, or two or more, selected from among an RH fluoride, an RH oxide, and an RH oxyfluoride) are present, in this order from the magnet, on the surface of a sintered R-T-B based magnet that is provided. The RLM alloy contains RL in an amount of 50 at % or more, and has a melting point which is equal to or less than the heat treatment temperature, and a heat treatment is performed while a powder of the RLM alloy and a powder of the RH compound are present on the surface of the sintered R-T-B based magnet at a mass ratio of RLM alloy:RH compound=9.6:0.4 to 5:5.

In a preferred embodiment, the amount of RH in its powder to be present on the surface of the sintered R-T-B based magnet is 0.03 to 0.35 mg per 1 $mm^2$ of the magnet surface.

One embodiment includes a step of applying onto the surface of the sintered R-T-B based magnet a layer of RLM alloy powder particles, which layer is at least one particle thick or greater, and then applying a layer of RH compound powder particles.

One embodiment includes applying on a surface of an upper face of the sintered R-T-B based magnet a slurry containing a powder mixture of an RLM alloy powder and an RH compound powder and a binder and/or a solvent, and forming a layer of RLM alloy powder particles, which layer is one particle thick or greater, on the surface of the sintered R-T-B based magnet.

In one embodiment, the RH compound is an RH fluoride and/or an RH oxyfluoride.

Advantageous Effects of Invention

According to an embodiment of the present invention, an RLM alloy is able to reduce an RH compound with a higher efficiency than conventional, thus allowing RH to be diffused inside a sintered R-T-B based magnet. As a result, with a smaller RH amount than in the conventional techniques, $H_{cJ}$ can be improved to a similar level to or higher than by the conventional techniques.

DESCRIPTION OF EMBODIMENTS

Figure 1:
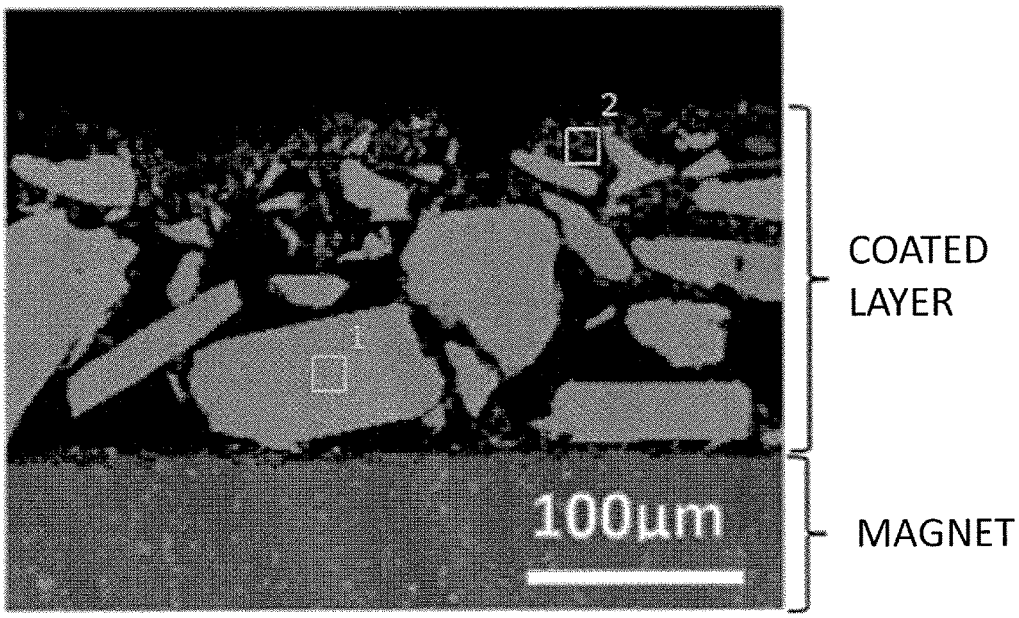
FIG. 1 is a diagram showing a cross-sectional SEM photograph of a coated layer according to Example.

A method for producing a sintered R-T-B based magnet according to the present invention includes, while a layer of RLM alloy powder particles, which layer is at least one particle thick or greater, and a layer of RH compound powder particles are present, in this order from the magnet, on the surface of a sintered R-T-B based magnet that is provided, a step of performing a heat treatment at a sintering temperature of the sintered R-T-B based magnet or lower. The RLM alloy contains RL in an amount of 50 at % or more, and has a melting point which is equal to or less than the heat treatment temperature, and a heat treatment is performed while a powder of the RLM alloy and a powder of the RH compound are present on the surface of the sintered R-T-B based magnet at a mass ratio of RLM alloy:RH compound=9.6:0.4 to 5:5.

As a method of improving $H_{cJ}$ by making effective use of smaller amounts of RH, the inventor has thought as effective a method which performs a heat treatment while an RH compound is present, on the surface of a sintered R-T-B based magnet, together with a diffusion auxiliary agent that reduces the RH compound during the heat treatment. Through a study by the inventor, it has been found that an alloy (RLM alloy) which combines a specific RL and M, the RLM alloy containing RL in an amount of 50 at % or more and having a melting point which is equal to or less than the heat treatment temperature, provides an excellent ability to reduce the RH compound that is present on the magnet surface. Furthermore, it has been found that the melted RLM alloy will efficiently reduce the RH compound, thus causing RH to efficiently diffuse to the inside of the sintered R-T-B based magnet, by: performing a heat treatment at a temperature which is equal to or greater than the melting point of the RLM alloy while a layer of RLM alloy powder particles, which layer is at least one particle thick or greater, and a layer of RH compound powder particles are present, in this order from the magnet, are present on the surface of the sintered R-T-B based magnet, that is, while a layer of RLM alloy powder particles (which layer is at least one particle thick or greater) that is in contact with the surface of the sintered R-T-B based magnet is present, with a layer of RH compound powder particles thereon. It is considered that the RH compound is reduced by the RLM alloy, and substantially RH alone diffuses to the inside of the sintered R-T-B based magnet. Thus it has been found that, even when the RH compound contains fluorine, the fluorine in the RH compound hardly diffuses to the inside of the sintered R-T-B based magnet. It has also been found that, when the RH compound is an RH fluoride and/or an RH oxyfluoride, a powder particle layer of such an RH compound is difficult to melt at the heat treatment, and that the use of a layer of RH compound powder particles as the outermost layer hinders seizing onto a treatment vessel or a baseplate that is used in the heat treatment, thus providing very good workability.

In the present specification, any substance containing an RH is referred to as a "diffusion agent", whereas any substance that reduces the RH in a diffusion agent so as to render it ready to diffuse is referred to as a "diffusion auxiliary agent".

Hereinafter, preferable embodiments of the present invention will be described in detail.

[Sintered R-T-B Based Magnet Matrix]

First, a sintered R-T-B based magnet matrix, in which to diffuse a heavy rare-earth element RH, is provided in the present invention. In the present specification, for ease of understanding, a sintered R-T-B based magnet in which to diffuse a heavy rare-earth element RH may be strictly differentiated as a sintered R-T-B based magnet matrix; it is to be understood that the term "sintered R-T-B based magnet" is inclusive of any such "sintered R-T-B based magnet matrix". Those which are known can be used as this sintered R-T-B based magnet matrix, having the following composition, for example.

rare-earth element R: 12 to 17 at %

B ((boron), part of which may be replaced with C (carbon)): 5 to 8 at % additive element(s) M' (at least one selected from the group consisting of Al, Ti, V, Cr, Mn, Ni, Cu, Zn, Ga, Zr, Nb, Mo, Ag, In, Sn, Hf, Ta, W, Pb and Bi): 0 to 2 at %

T (transition metal element, which is mainly Fe and may include Co) and inevitable impurities: balance Herein, the rare-earth element R consists essentially of a light rare-earth element RL (Nd and/or Pr), but may contain a heavy rare-earth element RH. In the case where a heavy rare-earth element is to be contained, preferably at least one of Dy and Tb, which are heavy rare-earth elements RH, is contained.

A sintered R-T-B based magnet matrix of the above composition is produced by any arbitrary production method.

[Diffusion Auxiliary Agent]

As the diffusion auxiliary agent, a powder of an RLM alloy is used. Suitable RL's are light rare-earth elements having a high effect of reducing RH compounds; and RL is Nd and/or Pr. M is one or more selected from among Cu, Fe, Ga, Co, Ni and Al. Among others, use of an Nd—Cu alloy or an Nd—Al alloy is preferable because Nd's ability to reduce an RH compound will be effectively exhibited and a higher effect of $H_{cJ}$ improvement will be obtained. As the RLM alloy, an alloy is used which contains RL in an amount of 50 at % or more, such that the melting point thereof is equal to or less than the heat treatment temperature. The RLM alloy preferably contains RL in an amount of 65 at % or more. Since RL has a high ability to reduce an RH compound, and its melting point is equal to or less than the heat treatment temperature, an RLM alloy containing RL in an amount of 50 at % or more will melt during the heat treatment to efficiently reduce the RH compound, and the RH which has been reduced at a higher rate will diffuse into the sintered R-T-B based magnet, such that it can efficiently improve $H_{cJ}$ of the sintered R-T-B based magnet even in a small amount. From the standpoint of attaining uniform application, the particle size of the RLM alloy powder is preferably 500 μm or less. The particle size of the RLM alloy powder is preferably 150 μm or less, and more preferably 100 μm or less. Too small a particle size of the RLM alloy powder is likely to result in oxidation, and from the standpoint of oxidation prevention, the lower limit of the particle size of the RLM alloy powder is about 5 μm. Typical examples of the particle size of the RLM alloy powder are 20 to 100 μm. Note that the particle size of a powder may be measured by determining the sizes of the largest powder particle and the smallest powder particle through microscopic observation, for example. Alternatively, by using sieves, any powder that is larger than the upper limit and any powder that is smaller than the lower limit may be eliminated before use. For example, powder may be sieved by using meshes with an opening of 0.50 mm, whereby the particle size of the powder can be adjusted to 500 μm or less.

Although there is no particular limitation as to the method of producing the diffusion auxiliary agent, examples thereof include a method which involves providing an ingot of the RLM alloy and pulverizing the ingot, and a method which involves providing an alloy ribbon by roll quenching, and pulverizing the alloy ribbon. From a pulverization ease standpoint, roll quenching is preferably used.

[Diffusion Agent]

As the diffusion agent, a powder of an RH compound (where RH is Dy and/or Tb; and the RH compound is one, or two or more, selected from among an RH fluoride, an RH oxide, and an RH oxyfluoride) is used. The RH compound powder is equal to or less than the RLM alloy powder by mass ratio; therefore, for uniform application of the RH compound powder, the particle size of the RH compound powder is preferably small. According to a study by the inventor, the particle size of the RH compound powder is preferably 20 μm or less, and more preferably 10 μm or less in terms of the aggregated particle size. Smaller ones are on the order of several μm as primary particles.

There is no particular limitation as to the production method of the diffusion agent, either. For example, a powder of RH fluoride can be produced through precipitation from a solution containing an hydrate of RH, or by any other known method.

[Application]

There is no particular limitation as to the method for allowing a diffusion agent and a diffusion auxiliary agent to be present on the surface of the sintered R-T-B based magnet, i.e., the method for ensuring that a layer of RLM alloy powder particles, which layer is at least one particle thick or greater, and a layer of RH compound powder particles are present in this order from the magnet; any method may be used. For example, a method may be adopted which involves: applying a slurry which is produced by mixing an RLM alloy powder and a binder and/or a solvent such as pure water or an organic solvent onto the surface of the sintered R-T-B based magnet; optional drying; and thereafter applying thereon a slurry which is produced by mixing an RH compound powder and a binder and/or a solvent. In other words, methods of separately applying and forming a layer of RLM alloy powder particles and a layer of RH compound powder particles may be adopted.

When separately applying and forming a layer of RLM alloy powder particles and a layer of RH compound powder particles, some RLM alloy powder may be allowed to be mixed in the RH compound powder to be applied. In other words, so long as the overall proportions of the RLM alloy and the RH compound are within the ranges according to the present invention, RH compound powder and RLM alloy powder may be contained in the layer of RH compound powder particles. Since the RH compound powder is smaller in amount than the RLM alloy powder, allowing RLM alloy powder to be mixed in the RH compound powder for application should make it easy to adjust the applied amount of RH compound powder. In this case, the RLM alloy powder to be mixed in the RH compound powder may be the same kind as, or a different kind from, the RLM alloy powder in the underlayer. In other words, the RLM alloy in the underlayer may be an RLAl alloy while the RLM alloy mixed in the RH compound may be an RLCu alloy, for example.

When a layer of RLM alloy powder particles and a layer of RH compound powder particles are separately formed, the method for allowing them to be present on the surface of the sintered R-T-B based magnet may be any of methods (1) to (3) as follows.

(1) A method which spreads an RLM alloy powder, and then an RH compound powder or a powder mixture of an RLM alloy powder and an RH compound powder, on the surface of the sintered R-T-B based magnet.

(2) A method which first applies a slurry that is produced by uniformly mixing the RLM alloy powder and a binder and/or a solvent onto the surface of the sintered R-T-B based magnet, then dries it, and further applies thereon a slurry that is produced by uniformly mixing an RH compound powder or a powder mixture of an RLM alloy powder and an RH compound powder with a binder and/or a solvent.

(3) A method which first immerses the sintered R-T-B based magnet in a solution that is obtained by dispersing the RLM alloy powder in a solvent such as pure water or an organic solvent, then retrieves and dries it, and further allows the sintered R-T-B based magnet that has been dried to be immersed in a solution that is obtained by dispersing an RH compound powder or a powder mixture of an RLM alloy powder and an RH compound powder in a solvent such as pure water or an organic solvent, and then retrieves it.

Without particular limitation, any binder and/or solvent may be used that can be removed via pyrolysis or evaporation, etc., from the surface of the sintered R-T-B based magnet at a temperature which is equal to or less than the melting point of the diffusion auxiliary agent during the temperature elevating process in a subsequent heat treatment.

Alternatively, a slurry which is produced by uniformly mixing a powder mixture of an RLM alloy powder and an RH compound powder with a binder and/or a solvent may be applied to the surface of an upper face of the sintered R-T-B based magnet, and then allowed to stand still, thus allowing the RLM alloy powder to settle faster based on the difference in sedimentation velocity between the RLM alloy powder and the RH compound powder, thus separating it into a layer of RLM alloy powder particles and a layer of RH compound powder particles. As a result, a layer of RLM alloy powder particles (which layer is at least one particle thick or greater)

that is in contact with the surface of the sintered R-T-B based magnet, and a layer of RH compound powder particles thereon can be formed. Note that the "upper face of the sintered R-T-B based magnet" is a face of the sintered R-T-B based magnet that faces vertically upward when the slurry is applied.

When applying a slurry to the upper face of the sintered R-T-B based magnet, the sintered R-T-B based magnet may be vibrated with ultrasonic waves or the like to promote separation into the layer of RLM alloy powder particles and the layer of RH compound powder particles. At this time, it is desirable that the mixed ratio between the powder and the binder and/or solvent is 50:50 to 95:5 by mass ratio. Ensuring that the particle size of the RLM alloy powder is about 150 μm at the most and that the particle size of the RH compound powder is 20 μm or less is preferable because it will facilitate separation into a layer of RLM alloy powder particles and a layer of RH compound powder particles, thus making it easier to form a layer of RLM alloy powder particles (which layer is at least one particle thick or greater) that is in contact with the surface of the sintered R-T-B based magnet.

In the case where such layers are to be formed on the surface of two or more faces of the sintered R-T-B based magnet, the slurry is to be applied on one face at a time of the sintered R-T-B based magnet, with this face of slurry application always being the upper face.

This method of allowing a slurry in which an RLM alloy powder and an RH compound powder are mixed to be applied onto the sintered R-T-B based magnet, and thereafter separating it into a layer of RLM alloy powder particles and a layer of RH compound powder particles, promotes mass producibility. In order for this method to be carried out, it will be effective if the particle size of the RH compound powder is small relative to the particle size of the RLM alloy powder. The particle size may be determined by any arbitrary method of particle size measurement. For example, the particle size may be measured through microscopic observation of the particles, and if the RH compound powder is smaller than the RLM alloy powder, a difference in sedimentation velocity will occur between the RLM alloy powder and the RH compound powder, whereby separation into a layer of RLM alloy powder particles and a layer of RH compound powder particles can occur.

In the method of the present invention, the RLM alloy melts during the heat treatment because of its melting point being equal to or less than the heat treatment temperature, thus resulting in a state which allows the RH that has been reduced highly efficiently to easily diffuse to the inside of the sintered R-T-B based magnet. Therefore, no particular cleansing treatment, e.g., pickling, needs to be performed for the surface of the sintered R-T-B based magnet prior to introducing the RLM alloy powder and the RH compound powder onto the surface of the sintered R-T-B based magnet. Of course, this is not to say that such a cleansing treatment should be avoided.

The ratio by which the RLM alloy and the RH compound in powder state are present on the surface of the sintered R-T-B based magnet (before the heat treatment) is, by mass ratio, RLM alloy:RH compound=9.6:0.4 to 5:5. More preferably, the ratio by which they are present is, RLM alloy:RH compound=9.5:0.5 to 6:4. Although the present invention does not necessarily exclude presence of any powder (third powder) other than the RLM alloy and RH compound powders on the surface of the sintered R-T-B based magnet, care must be taken so that any third powder will not hinder the RH in the RH compound from diffusing to the inside of the sintered R-T-B based magnet. It is desirable that the "RLM alloy and RH compound" powders account for a mass ratio of 70% or more in all powder that is present on the surface of the sintered R-T-B based magnet.

According to the present invention, it is possible to efficiently improve $H_{cJ}$ of the sintered R-T-B based magnet with a small amount of RH. The amount of RH in the powder to be present on the surface of the sintered R-T-B based magnet is preferably 0.03 to 0.35 mg per 1 $mm^2$ of magnet surface, and more preferably 0.05 to 0.25 mg.

[Diffusion Heat Treatment]

While the RLM alloy powder and the RH compound powder are allowed to be present on the surface of the sintered R-T-B based magnet, a heat treatment is performed. Since the RLM alloy powder will melt after the heat treatment is begun, the RLM alloy does not always need to maintain a "powder" state during the heat treatment. The ambient for the heat treatment is preferably a vacuum, or an inert gas ambient. The heat treatment temperature is a temperature which is equal to or less than the sintering temperature (specifically, e.g. 1000° C. or less) of the sintered R-T-B based magnet, and yet higher than the melting point of the RLM alloy. The heat treatment time is 10 minutes to 72 hours, for example. After the above heat treatment, a further heat treatment may be conducted, as necessary, at 400 to 700° C. for 10 minutes to 72 hours. Note that, in order to prevent seizing between the sintered R-T-B based magnet and the treatment vessel, $Y_2O_3$, $ZrO_2$, $Nd_2O_3$, or the like may be applied or spread on the bottom face of the treatment vessel or the baseplate on which the sintered R-T-B based magnet is placed.

EXAMPLES

Experimental Example 1

First, by a known method, a sintered R-T-B based magnet with the following mole fractions was produced: Nd=13.4, B=5.8, Al=0.5, Cu=0.1, Co=1.1, balance=Fe (at %). By machining this, a sintered R-T-B based magnet matrix which was 6.9 mm×7.4 mm×7.4 mm was obtained. Magnetic characteristics of the resultant sintered R-T-B based magnet matrix were measured with a B-H tracer, which indicated an $H_{cJ}$ of 1035 kA/m and a $B_r$ of 1.45 T. As will be described later, magnetic characteristics of the sintered R-T-B based magnet having undergone the heat treatment are to be measured only after the surface of the sintered R-T-B based magnet is removed via machining. Accordingly, the sintered R-T-B based magnet matrix also had its surface removed via machining by 0.2 mm each, thus resulting in a 6.5 mm×7.0 mm×7.0 mm size, before the measurement was taken. The amounts of impurities in the sintered R-T-B based magnet matrix was separately measured with a gas analyzer, which showed oxygen to be 760 mass ppm, nitrogen 490 mass ppm, and carbon 905 mass ppm.

Next, a diffusion auxiliary agent having a composition as shown in Table 1 was provided. The diffusion auxiliary agent was obtained by using a coffee mill to pulverize an alloy ribbon which had been produced by rapid quenching technique, resulting in a particle size of 150 μm or less. A powder of the resultant diffusion auxiliary agent, a $TbF_3$ powder, a $DyF_3$ powder, a $Tb_4O_7$ powder or a $Dy_2O_3$ powder with a particle size of 10 μm or less, and a 5 mass % aqueous solution of polyvinyl alcohol were mixed so that the diffusion auxiliary agent and the diffusion agent had a mixed mass ratio as shown in Table 1, while mixing the diffusion auxiliary agent+diffusion agent and the polyvinyl alcohol aqueous solution at a mass ratio of 2:1, thereby obtaining a slurry. This slurry was applied onto two 7.4 mm×7.4 mm faces of the sintered R-T-B based magnet matrix, so that the RH amount per 1 $mm^2$ of the surface of the sintered R-T-B based magnet (diffusion surface) had values as shown in Table 1. Specifically, the slurry was applied to a 7.4 mm×7.4 mm upper face of the sintered R-T-B based magnet matrix, and after being allowed to stand still for 1 minute, it was dried at 85° C. for 1 hour. Thereafter, the sintered R-T-B based magnet matrix was placed upside down, and the slurry was similarly applied, allowed to stand still, and dried.

Note that the melting point of the diffusion auxiliary agent, as will be discussed in this Example, denotes a value as read from a binary phase diagram of the RLM alloy.

TABLE 1

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 1 | $Nd_{70}Cu_{30}$ | 520 | $TbF_3$ | 4:6 | 0.07 | Comparative Example |
| 2 | $Nd_{70}Cu_{30}$ | 520 | $TbF_3$ | 5:5 | 0.07 | Example |
| 3 | $Nd_{70}Cu_{30}$ | 520 | $TbF_3$ | 6:4 | 0.07 | Example |
| 4 | $Nd_{70}Cu_{30}$ | 520 | $TbF_3$ | 7:3 | 0.07 | Example |
| 5 | $Nd_{70}Cu_{30}$ | 520 | $TbF_3$ | 8:2 | 0.07 | Example |
| 6 | $Nd_{70}Cu_{30}$ | 520 | $TbF_3$ | 9:1 | 0.07 | Example |
| 7 | $Nd_{70}Cu_{30}$ | 520 | $TbF_3$ | 9.6:0.4 | 0.07 | Example |
| 8 | $Nd_{70}Cu_{30}$ | 520 | $DyF_3$ | 8:2 | 0.07 | Example |
| 9 | $Nd_{70}Cu_{30}$ | 520 | NONE | — | 0.00 | Comparative Example |
| 10 | NONE | — | $TbF_3$ | — | 0.15 | Comparative Example |
| 11 | NONE | — | $DyF_3$ | — | 0.15 | Comparative Example |
| 101 | $Nd_{70}Cu_{30}$ | 520 | $Tb_4O_7$ | 4:6 | 0.07 | Comparative Example |
| 102 | $Nd_{70}Cu_{30}$ | 520 | $Tb_4O_7$ | 5:5 | 0.07 | Example |
| 103 | $Nd_{70}Cu_{30}$ | 520 | $Tb_4O_7$ | 6:4 | 0.07 | Example |
| 104 | $Nd_{70}Cu_{30}$ | 520 | $Tb_4O_7$ | 7:3 | 0.07 | Example |
| 105 | $Nd_{70}Cu_{30}$ | 520 | $Tb_4O_7$ | 8:2 | 0.07 | Example |
| 106 | $Nd_{70}Cu_{30}$ | 520 | $Tb_4O_7$ | 9:1 | 0.07 | Example |
| 107 | $Nd_{70}Cu_{30}$ | 520 | $Tb_4O_7$ | 9.6:0.4 | 0.07 | Example |
| 108 | $Nd_{70}Cu_{30}$ | 520 | $Dy_2O_3$ | 8:2 | 0.07 | Example |
| 109 | $Nd_{70}Cu_{30}$ | 520 | NONE | — | 0.00 | Comparative Example |
| 110 | NONE | — | $Tb_4O_7$ | — | 0.15 | Comparative Example |
| 111 | NONE | — | $Dy_2O_3$ | — | 0.15 | Comparative Example |

FIG. 1 shows a cross-sectional SEM photograph of a coated layer of a sample which was produced by the same method as Sample 5. Table 2 shows results of an EDX analysis of a portion shown in FIG. 1. As can be seen from FIG. 1 and Table 2, the powder of the diffusion auxiliary agent has settled, so that a layer of RLM alloy powder particles (which layer is one particle thick or greater) that is in contact with the surface of the sintered R-T-B based magnet matrix is formed, with a layer of RH compound (RH fluoride) particles thereupon. With respect to conditions other than those of Sample 5, samples of Example which were produced by the same method were also similarly subjected to cross-sectional observation, whereby it was similarly confirmed that a layer of RLM alloy powder particles (which layer was one particle thick or greater) being in contact with the surface of the sintered R-T-B based magnet matrix and a layer of RH compound particles thereupon had been formed.

TABLE 2

| analized portion | Nd | Cu | F | Tb |
|---|---|---|---|---|
| 1 | 84.3 | 15.7 | — | — |
| 2 | — | — | 20.7 | 79.3 |

[mass %]

The sintered R-T-B based magnet matrix having this slurry coated layer was placed on an Mo plate and accommodated in a process chamber (vessel), which was then lidded. (This lid does not hinder gases from going into and coming out of the chamber). This was accommodated in a heat treatment furnace, and in an Ar ambient of 100 Pa, a heat treatment was performed at 900° C. for 4 hours. As for the heat treatment, by warming up from room temperature with evacuation so that the ambient pressure and temperature met the aforementioned conditions, the heat treatment was performed under the aforementioned conditions. Thereafter, once cooled down to room temperature, the Mo plate was taken out and the sintered R-T-B based magnet was collected. The collected sintered R-T-B based magnet was returned in the process chamber, and again accommodated in the heat treatment furnace, and 2 hours of heat treatment was performed at 500° C. in a vacuum of 10 Pa or less. Regarding this heat treatment, too, by warming up from room temperature with evacuation so that the ambient pressure and temperature met the aforementioned conditions, the heat treatment was performed under the aforementioned conditions. Thereafter, once cooled down to room temperature, the sintered R-T-B based magnet was collected.

As for those Samples for which an RH oxide was used as the diffusion agent, in order to prevent seizing between the sintered R-T-B based magnet and the Mo plate, a $Y_2O_3$ powder which was mixed in ethanol was applied to the Mo plate and then dried, whereupon the sintered R-T-B based magnet was placed.

The surface of the resultant sintered R-T-B based magnet was removed via machining by 0.2 mm each, thus providing Samples 1 to 11 and 101 to 111 which were 6.5 mm×7.0 mm×7.0 mm. Magnetic characteristics of Samples 1 to 11 and 101 to 111 thus obtained were measured with a B-H tracer, and variations in $H_{cJ}$ and $B_r$ were determined. The results are shown in Table 3.

TABLE 3

| Sample No. | $H_{cJ}$ (kA/m) | $B_r$ (T) | $\Delta H_{cJ}$ (kA/m) | $\Delta$ Br (T) | |
|---|---|---|---|---|---|
| 1 | 1274 | 1.45 | 239 | 0.00 | Comparative Example |
| 2 | 1399 | 1.44 | 364 | −0.01 | Example |
| 3 | 1404 | 1.45 | 369 | 0.00 | Example |
| 4 | 1417 | 1.44 | 382 | −0.01 | Example |
| 5 | 1428 | 1.44 | 393 | −0.01 | Example |
| 6 | 1408 | 1.45 | 373 | 0.00 | Example |
| 7 | 1401 | 1.44 | 366 | −0.01 | Example |
| 8 | 1317 | 1.44 | 282 | −0.01 | Example |
| 9 | 1056 | 1.45 | 21 | 0.00 | Comparative Example |
| 10 | 1059 | 1.45 | 24 | 0.00 | Comparative Example |
| 11 | 1055 | 1.45 | 20 | 0.00 | Comparative Example |
| 101 | 1238 | 1.45 | 203 | 0.00 | Comparative Example |
| 102 | 1366 | 1.45 | 331 | 0.00 | Example |
| 103 | 1381 | 1.44 | 346 | −0.01 | Example |
| 104 | 1394 | 1.44 | 359 | −0.01 | Example |
| 105 | 1406 | 1.44 | 371 | −0.01 | Example |
| 106 | 1411 | 1.44 | 376 | −0.01 | Example |
| 107 | 1405 | 1.44 | 370 | −0.01 | Example |
| 108 | 1290 | 1.44 | 255 | −0.01 | Example |
| 109 | 1056 | 1.45 | 21 | 0.00 | Comparative Example |
| 110 | 1050 | 1.45 | 15 | 0.00 | Comparative Example |
| 111 | 1049 | 1.45 | 14 | 0.00 | Comparative Example |

As can be seen from Table 3, $H_{cJ}$ is significantly improved without lowering $B_r$ in the sintered R-T-B based magnets according to the production method of the present invention; on the other hand, in Samples 1 and 101 having more RH compound than defined by the mixed mass ratio according to the present invention, the $H_{cJ}$ improvement was not comparable to that attained by the present invention. Moreover, in Samples 9 and 109 where there was only one layer of RLM alloy powder particles, and in Samples 10, 11, 110 and 111 where there was only one layer of RH compound powder particles, the $H_{cJ}$ improvement was also not comparable to that attained by the present invention.

Figure 2:
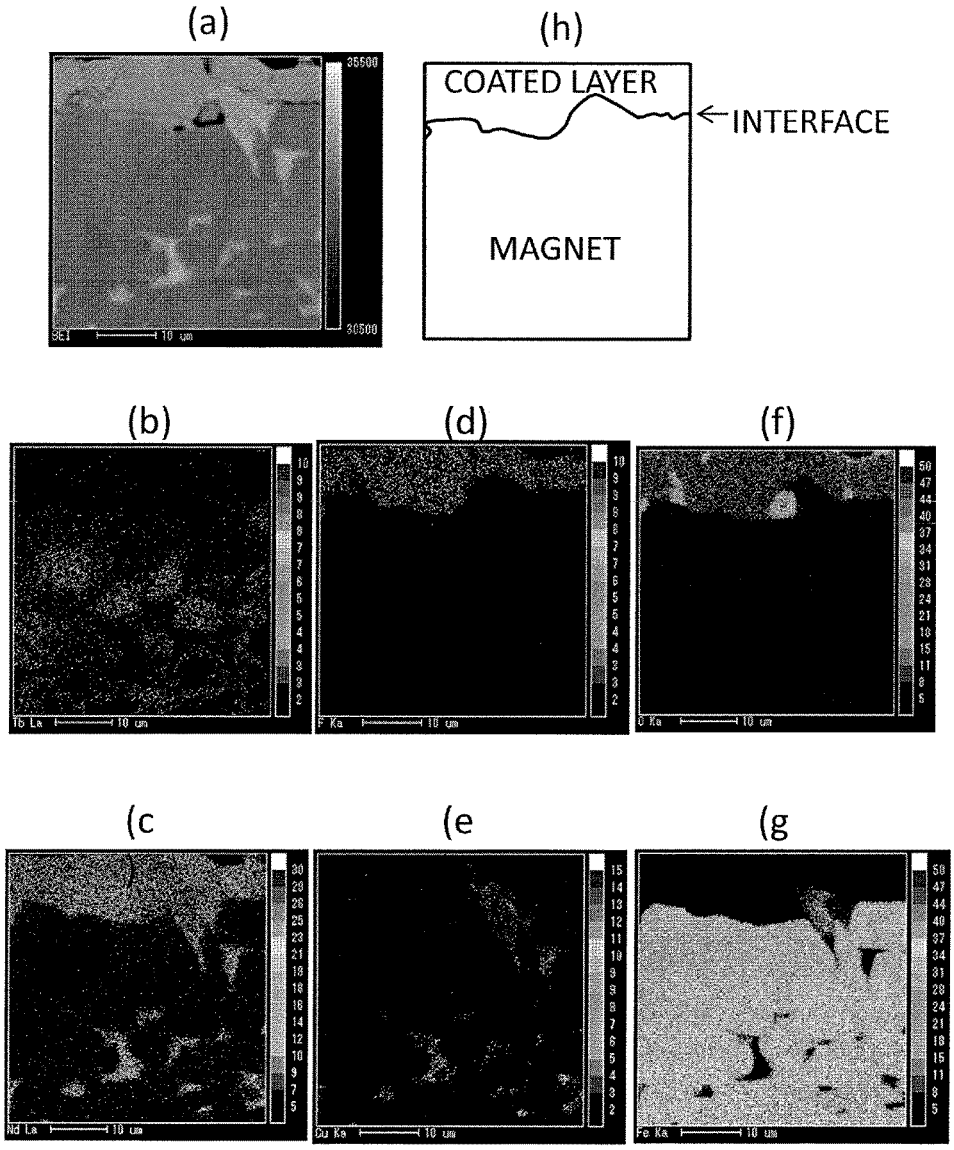
FIG. 2(*a*) is a diagram showing a SEM image; (*b*) to (*g*) are diagrams showing element mapping of, respectively, Tb, Nd, fluorine, Cu, oxygen, and Fe; and (*h*) is a diagram schematically showing the position of an interface of contact between a slurry coated layer and a magnet surface.

Furthermore, a magnet with an unmachined surface was produced, following the same conditions as in Sample 5 up to the heat treatment. With an EPMA (electron probe micro analyzer), this magnet was subjected to a cross-sectional element mapping analysis regarding the interface of contact between the slurry coated layer and the magnet surface. The results are shown in FIG. 2. FIG. 2(*a*) is a diagram showing a SEM image; and FIGS. 2(*b*) to (*g*) are diagrams showing element mapping of, respectively, Tb, Nd, fluorine, Cu, oxygen, and Fe. FIG. 2(*h*) is a diagram schematically showing the position of an interface of contact between the slurry coated layer and the magnet surface.

As can be seen from FIG. 2, above the interface of contact between the slurry coated layer and the magnet surface, fluorine was detected together with Nd and oxygen, with only very small amounts of Tb being detected at the portions where fluorine was detected. On the other hand, below the interface of contact (the inside of the magnet), Tb was detected, while fluorine was not detected. From the above, the significant improvement in $H_{cJ}$ in the sintered R-T-B based magnets according to the production method of the present invention is considered to be because the RLM alloy, as a diffusion auxiliary agent, reduced the RH fluoride so that RL combined with fluorine, while the reduced RH diffused to the inside of the magnet, thus efficiently contributing to the $H_{cJ}$ improvement. The fact that fluorine is hardly detected inside the magnet, i.e., that fluorine does not intrude to the inside of the magnet, may be considered as a factor which prevents $B_r$ from being significantly lowered.

Experimental Example 2

Sintered R-T-B based magnet matrices identical to those of Experimental Example 1 were provided. Next, diffusion auxiliary agents having compositions as shown in Table 4 and a $TbF_3$ powder or a $DyF_3$ powder having a particle size of 20 μm or less were provided, and each was mixed with a 5 mass % aqueous solution of polyvinyl alcohol, thus providing slurries of diffusion auxiliary agents and slurries of diffusion agents.

These slurries were applied onto two 7.4 mm×7.4 mm faces of the sintered R-T-B based magnet matrix, so that the mass ratio between the diffusion auxiliary agent and the diffusion agent and the RH amount per 1 $mm^2$ of the surface of the sintered R-T-B based magnet (diffusion surface) had values as shown in Table 4. Specifically, the slurry of a diffusion auxiliary agent was applied to a 7.4 mm×7.4 mm upper face of the sintered R-T-B based magnet matrix, and after it was dried at 85° C. for 1 hour, the slurry of a diffusion agent was applied and similarly dried. Thereafter, the sintered R-T-B based magnet matrix was placed upside down, and the slurries were similarly applied and dried.

The sintered R-T-B based magnet matrices having the slurries applied thereto were subjected to a heat treatment in a manner similar to Experimental Example 1, thus obtaining Samples 12 to 14 and 112 to 114, and their magnetic characteristics were measured; the results are shown in Table 5. Tables 4 and 5 also indicate values of Samples 4, 5, 8, 104, 105 and 108 from Experimental Example 1, which were under the same conditions as Samples 12 to 14 and 112 to 114 except for the application method.

TABLE 4

| | diffusion auxiliary agent | | diffusion agent | mass ratio (diffusion auxiliary | RH amount per 1 $mm^2$ | |
|---|---|---|---|---|---|---|
| Sample No. | composition (at. ratio) | melting point (° C.) | composition (at. ratio) | agent:diffusion agent) | of diffusion surface (mg) | |
| 4 | $Nd_{70}Cu_{30}$ | 520 | $TbF_3$ | 7:3 | 0.07 | mixed application |

TABLE 4-continued

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH amount per 1 $mm^2$ of diffusion surface (mg) | |
|---|---|---|---|---|---|---|
| 12 | $Nd_{70}Cu_{30}$ | 520 | $TbF_3$ | 7:3 | 0.07 | application in 2 layers |
| 5 | $Nd_{70}Cu_{30}$ | 520 | $TbF_3$ | 8:2 | 0.07 | mixed application |
| 13 | $Nd_{70}Cu_{30}$ | 520 | $TbF_3$ | 8:2 | 0.07 | application in 2 layers |
| 8 | $Nd_{70}Cu_{30}$ | 520 | $DyF_3$ | 8:2 | 0.07 | mixed application |
| 14 | $Nd_{70}Cu_{30}$ | 520 | $DyF_3$ | 8:2 | 0.07 | application in 2 layers |
| 104 | $Nd_{70}Cu_{30}$ | 520 | $Tb_4O_7$ | 7:3 | 0.07 | mixed application |
| 112 | $Nd_{70}Cu_{30}$ | 520 | $Tb_4O_7$ | 7:3 | 0.07 | application in 2 layers |
| 105 | $Nd_{70}Cu_{30}$ | 520 | $Tb_4O_7$ | 8:2 | 0.07 | mixed application |
| 113 | $Nd_{70}Cu_{30}$ | 520 | $Tb_4O_7$ | 8:2 | 0.07 | application in 2 layers |
| 108 | $Nd_{70}Cu_{30}$ | 520 | $Dy_2O_3$ | 8:2 | 0.07 | mixed application |
| 114 | $Nd_{70}Cu_{30}$ | 520 | $Dy_2O_3$ | 8:2 | 0.07 | application in 2 layers |

TABLE 5

| Sample No. | $H_{cJ}$ (kA/m) | $B_r$ (T) | $\Delta H_{cJ}$ (kA/m) | $\Delta$ Br (T) | |
|---|---|---|---|---|---|
| 4 | 1417 | 1.44 | 382 | −0.01 | mixed application |
| 12 | 1421 | 1.45 | 386 | 0.00 | application in 2 layers |
| 5 | 1428 | 1.44 | 393 | −0.01 | mixed application |
| 13 | 1426 | 1.44 | 391 | −0.01 | application in 2 layers |
| 8 | 1317 | 1.44 | 282 | −0.01 | mixed application |
| 14 | 1324 | 1.44 | 289 | −0.01 | application in 2 layers |
| 104 | 1394 | 1.44 | 359 | −0.01 | mixed application |
| 112 | 1385 | 1.44 | 350 | −0.01 | application in 2 layers |
| 105 | 1406 | 1.44 | 371 | −0.01 | mixed application |
| 113 | 1415 | 1.44 | 380 | −0.01 | application in 2 layers |
| 108 | 1290 | 1.44 | 255 | −0.01 | mixed application |
| 114 | 1282 | 1.45 | 247 | 0.00 | application in 2 layers |

As can be seen from Table 5, $H_{cJ}$ is significantly improved without lowering $B_r$ by the sintered R-T-B based magnets according to the production method of the present invention in the case where a diffusion auxiliary agent and a diffusion agent are separately applied to form a layer of RLM alloy powder particles (which layer is one particle thick or greater) that is in contact with the surface of the sintered R-T-B based magnet matrix, similarly to the case where a slurry in which a diffusion auxiliary agent and a diffusion agent were mixed is applied and allowed to stand still for the diffusion auxiliary agent to settle, thus to form a layer of RLM alloy powder particles (which layer is one particle thick or greater) that is in contact with the surface of the sintered R-T-B based magnet matrix.

Experimental Example 3

Samples 15 to 22, 38, 39, 115 to 122, 138 and 139 were obtained in a similar manner to Experimental Example 1, except for using diffusion auxiliary agents having compositions as shown in Table 6 and using powder mixtures obtained through mixing with a $TbF_3$ powder according to the mixed mass ratio shown in Table 6. Magnetic characteristics of Samples 15 to 22, 38, 39, 115 to 122, 138 and 139 thus obtained were measured with a B-H tracer, and variations in $H_{cJ}$ and $B_r$ were determined. The results are shown in Table 7.

TABLE 6

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 15 | $Nd_{95}Cu_5$ | 930 | $TbF_3$ | 8:2 | 0.07 | Comparative Example |
| 16 | $Nd_{85}Cu_{15}$ | 770 | $TbF_3$ | 8:2 | 0.07 | Example |
| 17 | $Nd_{50}Cu_{50}$ | 690 | $TbF_3$ | 8:2 | 0.07 | Example |
| 18 | $Nd_{27}Cu_{73}$ | 770 | $TbF_3$ | 8:2 | 0.07 | Comparative Example |

TABLE 6-continued

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 $mm^2$ of diffusion surface (mg) | |
|---|---|---|---|---|---|---|
| 19 | $Nd_{80}Fe_{20}$ | 690 | $TbF_3$ | 8:2 | 0.07 | Example |
| 20 | $Nd_{80}Ga_{20}$ | 650 | $TbF_3$ | 8:2 | 0.07 | Example |
| 21 | $Nd_{80}Co_{20}$ | 630 | $TbF_3$ | 8:2 | 0.07 | Example |
| 22 | $Nd_{80}Ni_{20}$ | 580 | $TbF_3$ | 8:2 | 0.07 | Example |
| 38 | $Pr_{68}Cu_{32}$ | 470 | $TbF_3$ | 8:2 | 0.07 | Example |
| 39 | $Nd_{55}Pr_{15}Cu_{30}$ | 510 | $TbF_3$ | 8:2 | 0.07 | Example |
| 115 | $Nd_{95}Cu_5$ | 930 | $Tb_4O_7$ | 8:2 | 0.07 | Comparative Example |
| 116 | $Nd_{85}Cu_{15}$ | 770 | $Tb_4O_7$ | 8:2 | 0.07 | Example |
| 117 | $Nd_{50}Cu_{50}$ | 690 | $Tb_4O_7$ | 8:2 | 0.07 | Example |
| 118 | $Nd_{27}Cu_{73}$ | 770 | $Tb_4O_7$ | 8:2 | 0.07 | Comparative Example |
| 119 | $Nd_{80}Fe_{20}$ | 690 | $Tb_4O_7$ | 8:2 | 0.07 | Example |
| 120 | $Nd_{80}Ga_{20}$ | 650 | $Tb_4O_7$ | 8:2 | 0.07 | Example |
| 121 | $Nd_{80}Co_{20}$ | 630 | $Tb_4O_7$ | 8:2 | 0.07 | Example |
| 122 | $Nd_{80}Ni_{20}$ | 580 | $Tb_4O_7$ | 8:2 | 0.07 | Example |
| 138 | $Pr_{68}Cu_{32}$ | 470 | $Tb_4O_7$ | 8:2 | 0.07 | Example |
| 139 | $Nd_{55}Pr_{15}Cu_{30}$ | 510 | $Tb_4O_7$ | 8:2 | 0.07 | Example |

TABLE 7

| Sample No. | $H_{cJ}$ (kA/m) | $B_r$ (T) | $\Delta H_{cJ}$ (kA/m) | $\Delta$ Br (T) | |
|---|---|---|---|---|---|
| 15 | 1218 | 1.45 | 183 | 0.00 | Comparative Example |
| 16 | 1364 | 1.44 | 329 | −0.01 | Example |
| 17 | 1333 | 1.44 | 298 | −0.01 | Example |
| 18 | 1089 | 1.45 | 54 | 0.00 | Comparative Example |
| 19 | 1355 | 1.44 | 320 | −0.01 | Example |
| 20 | 1352 | 1.44 | 317 | −0.01 | Example |
| 21 | 1360 | 1.44 | 325 | −0.01 | Example |
| 22 | 1350 | 1.45 | 315 | 0.00 | Example |
| 38 | 1433 | 1.44 | 398 | −0.01 | Example |
| 39 | 1425 | 1.44 | 390 | −0.01 | Example |
| 115 | 1200 | 1.45 | 165 | 0.00 | Comparative Example |
| 116 | 1343 | 1.44 | 308 | −0.01 | Example |
| 117 | 1315 | 1.45 | 280 | 0.00 | Example |
| 118 | 1076 | 1.45 | 41 | 0.00 | Comparative Example |
| 119 | 1329 | 1.44 | 294 | −0.01 | Example |
| 120 | 1327 | 1.44 | 292 | −0.01 | Example |
| 121 | 1323 | 1.44 | 288 | −0.01 | Example |
| 122 | 1321 | 1.44 | 286 | −0.01 | Example |
| 138 | 1419 | 1.44 | 384 | −0.01 | Example |
| 139 | 1418 | 1.45 | 383 | 0.00 | Example |

As can be seen from Table 7, also in the case of using diffusion auxiliary agents of different compositions from those of the diffusion auxiliary agents used in Experimental Example 1 (Samples 16, 17, 19 to 22, 38, 39, 116, 117, 119 to 122, 138, 139), $H_{cJ}$ is significantly improved without lowering $B_r$ in the sintered R-T-B based magnets according to the production method of the present invention. However, in Samples 15 and 115 where the melting point of the RLM alloy exceeded the heat treatment temperature (900° C.), and in Samples 18 and 118 where a diffusion auxiliary agent with less than 50 at % of an RL was used, the $H_{cJ}$ improvement was not comparable to that attained by the present invention.

As for the aforementioned Examples (Samples 16, 17, 19 to 22, 38, 39, 116, 117, 119 to 122, 138, 139), samples which were allowed to undergo slurry application, stand still, and be dried by the same method was subjected to cross-sectional SEM observation similarly to the Samples in Experimental Example 1, whereby it was confirmed that a layer of RLM alloy powder particles (which layer was one particle thick or greater) being in contact with the surface of the sintered R-T-B based magnet matrix and a layer of RH compound particles thereupon had been formed.

Experimental Example 4

Samples 23 to 28 and 123 to 128 were obtained in a similar manner to Experimental Example 2, except for using diffusion auxiliary agents having compositions as shown in Table 8, applied so that the mass ratio between the diffusion auxiliary agent and the diffusion agent and the RH amount per 1 $mm^2$ of the surface of the sintered R-T-B based magnet (diffusion surface) had values as shown in Table 8. Samples 26 and 126 had their RH amount per 1 $mm^2$ of the surface of the sintered R-T-B based magnet (diffusion surface) increased to a value as indicated in Table 8, while having the same diffusion auxiliary agent and diffusion agent and the same mass ratio as those in Sample 1, which did not attain a favorable result in Experimental Example 1 (where more RH compound than defined by the mass ratio according to the present invention was contained). Samples 27 and 127 had their RH amount per 1 $mm^2$ of the surface of the sintered R-T-B based magnet (diffusion surface) increased to a value as indicated in Table 8, while having the same diffusion auxiliary agent and diffusion agent and the same mass ratio as those in Samples 18 and 118, which did not attain favorable results in Experimental Example 3 (where a diffusion auxiliary agent with less than 50 at % of an RL was used). In Samples 28 and 128, an RHM alloy was used as the diffusion auxiliary agent. Magnetic characteristics of Samples 23 to 28 and 123 to 128 thus obtained were measured with a B-H tracer, and variations in $H_{cJ}$ and $B_r$ were determined. The results are shown in Table 9. Note that each table indicates values of Sample 5 as an Example for comparison.

TABLE 8

| Sample No. | diffusion auxiliary agent composition (at. ratio) | diffusion auxiliary agent melting point (° C.) | diffusion agent composition (at. ratio) | mass ratio (diffusion auxiliary agent:diffusion agent) | RH amount per 1 $mm^2$ of diffusion surface (mg) | |
|---|---|---|---|---|---|---|
| 5 | $Nd_{70}Cu_{30}$ | 520 | $TbF_3$ | 8:2 | 0.07 | Example |
| 23 | $Nd_{70}Cu_{30}$ | 520 | $TbF_3$ | 8:2 | 0.04 | Example |
| 24 | $Nd_{70}Cu_{30}$ | 520 | $TbF_3$ | 8:2 | 0.15 | Example |
| 25 | $Nd_{70}Cu_{30}$ | 520 | $TbF_3$ | 8:2 | 0.30 | Example |
| 26 | $Nd_{70}Cu_{30}$ | 520 | $TbF_3$ | 4:6 | 0.40 | Comparative Example |
| 27 | $Nd_{27}Cu_{73}$ | 770 | $TbF_3$ | 8:2 | 0.40 | Comparative Example |
| 28 | $Tb_{74}Cu_{26}$ | 860 | $TbF_3$ | 8:2 | 0.80 | Comparative Example |
| 105 | $Nd_{70}Cu_{30}$ | 520 | $Tb_4O_7$ | 8:2 | 0.07 | Example |
| 123 | $Nd_{70}Cu_{30}$ | 520 | $Tb_4O_7$ | 8:2 | 0.04 | Example |
| 124 | $Nd_{70}Cu_{30}$ | 520 | $Tb_4O_7$ | 8:2 | 0.15 | Example |
| 125 | $Nd_{70}Cu_{30}$ | 520 | $Tb_4O_7$ | 8:2 | 0.30 | Example |
| 126 | $Nd_{70}Cu_{30}$ | 520 | $Tb_4O_7$ | 4:6 | 0.40 | Comparative Example |
| 127 | $Nd_{27}Cu_{73}$ | 770 | $Tb_4O_7$ | 8:2 | 0.40 | Comparative Example |
| 128 | $Tb_{74}Cu_{26}$ | 860 | $Tb_4O_7$ | 8:2 | 0.80 | Comparative Example |

TABLE 9

| Sample No. | $H_{cJ}$ (kA/m) | $B_r$ (T) | $\Delta H_{cJ}$ (kA/m) | $\Delta$ Br (T) | |
|---|---|---|---|---|---|
| 5 | 1428 | 1.44 | 393 | −0.01 | Example |
| 23 | 1407 | 1.44 | 372 | −0.01 | Example |
| 24 | 1433 | 1.44 | 398 | −0.01 | Example |
| 25 | 1428 | 1.44 | 393 | −0.01 | Example |
| 26 | 1409 | 1.44 | 374 | −0.01 | Comparative Example |
| 27 | 1110 | 1.45 | 75 | 0.00 | Comparative Example |
| 28 | 1426 | 1.44 | 391 | −0.01 | Comparative Example |
| 105 | 1406 | 1.44 | 371 | −0.01 | Example |
| 123 | 1378 | 1.44 | 343 | −0.01 | Example |
| 124 | 1413 | 1.45 | 378 | 0.00 | Example |
| 125 | 1420 | 1.44 | 385 | −0.01 | Example |
| 126 | 1400 | 1.44 | 365 | −0.01 | Comparative Example |
| 127 | 1096 | 1.45 | 61 | 0.00 | Comparative Example |
| 128 | 1424 | 1.44 | 389 | −0.01 | Comparative Example |

As can be seen from Table 9, also in the case of applying a diffusion auxiliary agent and a diffusion agent so that the RH amount per 1 $mm^2$ of the surface of the sintered R-T-B based magnet (diffusion surface) has a value as shown in Table 8, $H_{cJ}$ is significantly improved without lowering $B_r$ in the sintered R-T-B based magnets according to the production method of the present invention. For these Samples of Example, too, samples which were allowed to undergo slurry application, stand still, and be dried by the same method was subjected to cross-sectional SEM observation, whereby it was confirmed that a layer of RLM alloy powder particles (which layer was one particle thick or greater) being in contact with the surface of the sintered R-T-B based magnet matrix and a layer of RH compound particles thereupon had been formed.

In Samples 26 and 126 containing more RH compound than defined by the mass ratio according to the present invention, a similar $H_{cJ}$ improvement to that attained by the sintered R-T-B based magnets according to the production method of the present invention was made. However, their RH amount per 1 $mm^2$ of the surface of the sintered R-T-B based magnet (diffusion surface) was greater than that in the sintered R-T-B based magnet according to the present invention; thus, more RH than in the present invention was required in order to attain a similar level of $H_{cJ}$ improvement, falling short of an effect of improving $H_{cJ}$ with only a small amount of RH. In Samples 27 and 127 where a diffusion auxiliary agent with less than 50 at % of an RL was used, the proportion of RL in the diffusion auxiliary agent was small, and thus a similar $H_{cJ}$ improvement to that attained by the sintered R-T-B based magnets according to the production method of the present invention was not attained even by increasing the RH amount per 1 $mm^2$ of the surface of the sintered R-T-B based magnet (diffusion surface). In Samples 28 and 128 where an RHM alloy was used as the diffusion auxiliary agent, a similar $H_{cJ}$ improvement to that attained by the sintered R-T-B based magnets according to the production method of the present invention was made. However, their RH amount per 1 $mm^2$ of the surface of the sintered R-T-B based magnet (diffusion surface) was much greater than that in the sintered R-T-B based magnet according to the present invention; thus, more RH than in the present invention was required in order to attain a similar level of $H_{cJ}$ improvement, falling short of an effect of improving $H_{cJ}$ with only a small amount of RH.

Experimental Example 5

Samples 29 to 31 and 129 to 131 were obtained in a similar manner to Experimental Example 1, except for producing a slurry by mixing a diffusion auxiliary agent of the composition $Nd_{70}Cu_{30}$ (at %) and a $TbF_3$ powder (diffusion agent) so that the diffusion auxiliary agent:diffusion agent was 9:1, and performing a heat treatment under conditions as shown in Table 10. Magnetic characteristics of Samples 29 to and 129 to 131 thus obtained were measured with a B-H tracer, and variations in $H_{cJ}$ and $B_r$ were determined. The results are shown in Table 11.

TABLE 10

| Sample No. | heat treatment temperature (° C.) | heat treatment time (Hr) | |
|---|---|---|---|
| 29 | 900 | 8 | Example |
| 30 | 950 | 4 | Example |
| 31 | 850 | 16 | Example |
| 129 | 900 | 8 | Example |
| 130 | 950 | 4 | Example |
| 131 | 850 | 16 | Example |

TABLE 11

| Sample No. | $H_{cJ}$ (kA/m) | $B_r$ (T) | $\Delta H_{cJ}$ (kA/m) | $\Delta$Br (T) | |
|---|---|---|---|---|---|
| 29 | 1456 | 1.43 | 421 | −0.02 | Example |
| 30 | 1471 | 1.44 | 436 | −0.01 | Example |
| 31 | 1424 | 1.44 | 389 | −0.01 | Example |
| 129 | 1455 | 1.44 | 420 | −0.01 | Example |
| 130 | 1447 | 1.43 | 412 | −0.02 | Example |
| 131 | 1413 | 1.44 | 378 | −0.01 | Example |

As can be seen from Table 11, also in the case of performing a heat treatment under various heat treatment condition as shown in Table 10, $H_{cJ}$ is significantly improved without lowering $B_r$ in the sintered R-T-B based magnets according to the production method of the present invention.

Experimental Example 6

Samples 32 to 35 were obtained in a similar manner to Sample 5, and Samples 132 to 135 were obtained in a similar manner to Sample 105, except for using sintered R-T-B based magnet matrices of compositions, sintering temperatures, amounts of impurities, and magnetic characteristics as shown in Table 12. Magnetic characteristics of Samples 32 to 35 and 132 to 135 thus obtained were measured with a B-H tracer, and variations in $H_{cJ}$ and $B_r$ were determined. The results are shown in Table 13.

TABLE 12

| Sample No. | matrix composition (at %) | sintering temperature (° C.) | amount of impurities (mass ppm) oxygen | nitrogen | carbon | matrix $H_{cJ}$ (k A/m) | matrix $B_r$ (T) |
|---|---|---|---|---|---|---|---|
| 32, 132 | $Nd_{13.4}B_{5.8}Al_{0.5}Cu_{0.1}Fe_{bal.}$ | 1050 | 810 | 520 | 980 | 1027 | 1.44 |
| 33, 133 | $Nd_{12.6}Dy_{0.8}B_{5.8}Al_{0.5}Cu_{0.1}Co_{1.1}Fe_{bal.}$ | 1060 | 780 | 520 | 930 | 1205 | 1.39 |
| 34, 134 | $Nd_{13.7}B_{5.8}Al_{0.5}Cu_{0.1}Co_{1.1}Fe_{bal.}$ | 1040 | 1480 | 450 | 920 | 1058 | 1.44 |
| 35, 135 | $Nd_{14.5}B_{5.9}Al_{0.5}Cu_{0.1}Co_{1.1}Fe_{bal.}$ | 1035 | 4030 | 320 | 930 | 1073 | 1.41 |

TABLE 13

| Sample No. | $H_{cJ}$ (kA/m) | $B_r$ (T) | $\Delta H_{cJ}$ (kA/m) | $\Delta$Br (T) | |
|---|---|---|---|---|---|
| 32 | 1426 | 1.43 | 399 | −0.01 | Example |
| 33 | 1587 | 1.38 | 382 | −0.01 | Example |
| 34 | 1465 | 1.43 | 407 | −0.01 | Example |
| 35 | 1475 | 1.39 | 402 | −0.02 | Example |
| 132 | 1405 | 1.43 | 378 | −0.01 | Example |
| 133 | 1392 | 1.38 | 365 | −0.01 | Example |
| 134 | 1452 | 1.43 | 394 | −0.01 | Example |
| 135 | 1460 | 1.40 | 387 | −0.01 | Example |

As can be seen from Table 13, also in the case of using various sintered R-T-B based magnet matrices as shown in Table 12, $H_{cJ}$ is significantly improved without lowering $B_r$ in the sintered R-T-B based magnets according to the production method of the present invention.

Experimental Example 7

Samples 36 and 37 were obtained in similar manners to Sample 6 and Sample 19, respectively, except for using a $Tb_4O_7$ powder having a particle size of 20 μm or less as the diffusion agent. Magnetic characteristics of Samples 36 and thus obtained were measured with a B-H tracer, and variations in $H_{cJ}$ and $B_r$ were determined. Moreover, presence or absence of seizing with the Mo plate, when each Sample was taken out of the heat treatment furnace, was evaluated. The results are shown in Table 15.

In Samples 36 and 37 where a $Tb_4O_7$ powder was used as the diffusion agent, as shown in Table 15, the sintered R-T-B based magnet seized to the Mo plate, and magnetic characteristics of the sintered R-T-B based magnet could not be evaluated in a straightforward manner. Therefore, as for the magnetic characteristics of Samples 36 and 37, measurements were taken with respect to sintered R-T-B based magnets which were produced by allowing a $Y_2O_3$ powder which was mixed in ethanol to be applied between sintered R-T-B based magnet and the Mo plate and then drying it, thus to prevent seizing.

TABLE 14

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 mm² of diffusion surface (mg) | |
|---|---|---|---|---|---|---|
| 6 | $Nd_{70}Cu_{30}$ | 520 | $TbF_3$ | 9:1 | 0.07 | Example |
| 36 | $Nd_{70}Cu_{30}$ | 520 | $Tb_4O_7$ | 9:1 | 0.07 | Example |
| 19 | $Nd_{80}Fe_{20}$ | 690 | $TbF_3$ | 8:2 | 0.07 | Example |
| 37 | $Nd_{80}Fe_{20}$ | 690 | $Tb_4O_7$ | 8:2 | 0.07 | Example |

TABLE 15

| Sample No. | $H_{cJ}$ (k A/m) | $B_r$ (T) | Δ $H_{cJ}$ (k A/m) | Δ Br (T) | seizing | |
|---|---|---|---|---|---|---|
| 6 | 1408 | 0.00 | 373 | 0.00 | NO | Example |
| 36 | 1401 | −0.01 | 366 | −0.01 | YES | Example |
| 19 | 1397 | −0.01 | 362 | −0.01 | NO | Example |
| 37 | 1388 | −0.01 | 353 | −0.01 | YES | Example |

As can be seen from Table 15, as for the magnetic characteristics of Samples 36 and 37 where an RH oxide was used as the diffusion agent, $H_{cJ}$ was significantly improved without lowering $B_r$, to a level similar to that attained by the sintered R-T-B based magnets according to the production method of the present invention. However, it was found in these Samples that care must be taken to prevent seizing between the sintered R-T-B based magnet and the Mo plate, or else it would be difficult to collect the Sample, by applying a $Y_2O_3$ powder between the sintered R-T-B based magnet and the Mo plate upon heat treatment, etc.

Experimental Example 8

Sample 40 was obtained in a similar manner to Experimental Example 1, except for using a diffusion agent containing oxyfluoride and using a powder mixture obtained through mixing with a diffusion auxiliary agent shown in Table 16 at the mixed mass ratio shown in Table 16. Magnetic characteristics of Sample 40 thus obtained were measured with a B-H tracer, and variations in $H_{cJ}$ and $B_r$ were determined. The results are shown in Table 17. For comparison, Table 17 also indicates the result of Sample 4, which was produced under the same conditions but by using $TbF_3$ as the diffusion agent.

TABLE 16

| Sample No. | diffusion auxiliary agent composition (at. ratio) | diffusion auxiliary agent melting point (° C.) | diffusion agent composition (at. ratio) | mixed mass ratio (diffusion auxiliary agent:diffusion agent) | RH amount per 1 mm² of diffusion surface (mg) | |
|---|---|---|---|---|---|---|
| 4 | $Nd_{70}Cu_{30}$ | 520 | $TbF_3$ | 7:3 | 0.07 | Example |
| 40 | $Nd_{70}Cu_{30}$ | 520 | $TbF_3$ + TbOF | 7:3 | 0.07 | Example |

TABLE 17

| Sample No. | $H_{cJ}$ (kA/m) | $B_r$ (T) | ⊿ $H_{cJ}$ (kA/m) | ⊿ Br (T) | |
|---|---|---|---|---|---|
| 4 | 1417 | 1.44 | 382 | −0.01 | Example |
| 40 | 1410 | 1.44 | 375 | −0.01 | Example |

Hereinafter, the diffusion agent containing an oxyfluoride which was used in Sample 40 will be described. For reference's sake, $TbF_3$, which was used in Sample 4 and others, will also be described.

Regarding the diffusion agent powder of Sample 40 and the diffusion agent powder of Sample 4, an oxygen amount and a carbon amount were measured via gas analysis. The diffusion agent powder of Sample 4 is the same diffusion agent powder that was used in other Samples in which $TbF_3$ was used.

The diffusion agent powder of Sample 4 had an oxygen amount of 400 ppm, whereas the diffusion agent powder of Sample 40 had an oxygen amount of 4000 ppm. The carbon amount was less than 100 ppm in both.

By SEM-EDX, a cross-sectional observation and a component analysis for each diffusion agent powder were conducted. Sample 40 was divided into regions with a large oxygen amount and regions with a small oxygen amount. Sample 4 showed no such regions with different oxygen amounts.

The respective results of component analysis of Samples 4 and 40 are shown in Table 18.

TABLE 18

| Sample No. | diffusion agent composition (at. ratio) | analyzed position | Tb (at %) | F (at %) | O (at %) |
|---|---|---|---|---|---|
| 4 | $TbF_3$ | — | 26.9 | 70.1 | 3.0 |
| 40 | $TbF_3$ + TbOF | oxygen amount is small | 26.8 | 70.8 | 2.4 |
| | | oxygen amount is large | 33.2 | 46.6 | 20.2 |

In the regions of Sample 40 with large oxygen amounts, some Tb oxyfluoride which had been generated in the process of producing $TbF_3$ presumably remained. According to calculations, the oxyfluoride accounted for about 10% by mass ratio.

From the results of Table 18, it can be seen that $H_{cJ}$ was improved in the Sample using an RH fluoride, in which an oxyfluoride had partially remained, to a similar level as was attained in the Sample in which an RH fluoride was used. For Sample 40, too, samples which were allowed to undergo slurry application, stand still, and be dried by the same method was subjected to cross-sectional SEM observation, whereby it was confirmed that a layer of RLM alloy powder particles (which layer was one particle thick or greater) being in contact with the surface of the sintered R-T-B based magnet matrix and a layer of RH compound particles thereupon had been formed.

Experimental Example 9

A diffusion auxiliary agent was left at room temperature in the atmospheric air for 50 days, thereby preparing a diffusion auxiliary agent with an oxidized surface. Except for this aspect, Sample 41 was produced in a similar manner to Sample 5, and Sample 140 was produced in a similar manner to Sample 105. Note that the diffusion auxiliary agent having been left for 50 days was discolored black, and the oxygen content, which had been 670 ppm before the leaving, was increased to 4700 ppm.

A sintered R-T-B based magnet matrix was left in an ambient with a relative humidity 90% and a temperature of 60° C. for 100 hours, thus allowing red rust to occur in numerous places on its surface. Except for using such a sintered R-T-B based magnet matrix, Sample 42 was produced in a similar manner to Sample 5, and Sample 141 was produced in a similar manner to Sample 105. Magnetic characteristics of Samples 41, 42, 140 and 141 thus obtained were measured with a B-H tracer, and variations in $H_{cJ}$ and $B_r$ were determined. The results are shown in Table 19. For comparison, Table 19 also shows the results of Sample 5 and 105.

TABLE 19

| Sample No. | $H_{cJ}$ (kA/m) | $B_r$ (T) | $\Delta H_{cJ}$ (kA/m) | $\Delta$ Br (T) | |
|---|---|---|---|---|---|
| 5 | 1428 | 1.44 | 393 | −0.01 | Example |
| 41 | 1423 | 1.44 | 388 | −0.01 | Example |
| 42 | 1416 | 1.44 | 381 | −0.01 | Example |
| 105 | 1406 | 1.44 | 371 | −0.01 | Example |
| 140 | 1405 | 1.44 | 370 | −0.01 | Example |
| 141 | 1395 | 1.45 | 360 | 0.00 | Example |

From Table 19, it was found that the $H_{cJ}$ improvement is hardly affected even if the surface of the diffusion auxiliary agent or the sintered R-T-B based magnet matrix is oxidized. For Samples 41, 42, 140 and 141, too, samples which were allowed to undergo slurry application, stand still, and be dried by the same method was subjected to cross-sectional SEM observation, whereby it was confirmed that a layer of RLM alloy powder particles (which layer was one particle thick or greater) being in contact with the surface of the sintered R-T-B based magnet matrix and a layer of RH compound particles thereupon had been formed.

Thus, in one implementation, the present invention includes: a step of allowing powder particles of an alloy of RL and M (where RL is Nd and/or Pr; M is one or more elements selected from the group consisting of Cu, Fe, Ga, Co, Ni and Al) to be in contact with the surface of a sintered R-T-B based magnet; a step of allowing powder particles of a compound containing RH and fluorine (where RH is Dy and/or Tb) to be in contact with the powder particles of the RLM alloy; and subjecting the sintered R-T-B based magnet to a heat treatment at a temperature which is equal to or greater than the melting point of the RLM alloy and equal to or less than the sintering temperature of the sintered R-T-B based magnet. This heat treatment is begun while the powder particles of the alloy and the powder particles of the compound are present on the sintered R-T-B based magnet. Before the heat treatment is begun, the powder particles of the alloy may be distributed more densely at positions closer to the surface of the sintered R-T-B based magnet than are the powder particles of the compound. In one typical example, the powder particles of the alloy are located on the surface of the sintered R-T-B based magnet, in a manner of forming at least one layer, this layer being present between the powder particles of the compound and the surface of the sintered R-T-B based magnet. As a result, the powder particles of the compound are distributed at positions that are distant from the surface of the sintered R-T-B based magnet.

INDUSTRIAL APPLICABILITY

A method for producing a sintered R-T-B based magnet according to the present invention can provide a sintered R-T-B based magnet whose $H_{cJ}$ is improved with less of a heavy rare-earth element RH.

The invention claimed is:

1. A method for producing a sintered R-T-B based magnet, comprising:

a step of providing a sintered R-T-B based magnet, where R is one or more rare-earth elements, T is one or more transition metal elements, and B is boron or is boron and carbon;

a step of applying onto a surface of the sintered R-T-B based magnet a layer of an RLM alloy powder (where RL is Nd and/or Pr; M is one or more elements selected from the group consisting of Cu, Fe, Ga, Co, Ni and Al), the layer of the RLM powder being at least one particle thick or greater, and then applying a layer of an RH compound powder (where RH is Dy and/or Tb; and an RH compound of the RH compound powder is at least one selected from the group consisting of an RH fluoride, an RH oxide, and an RH oxyfluoride) to the layer of the RLM powder; and a step of performing a heat treatment at a sintering temperature of the sintered R-T-B based magnet or lower, wherein the RLM alloy powder contains RL in an amount of 50 at % or more, and a melting point of the RLM alloy powder is equal to or less than a temperature of the heat treatment; and the heat treatment is performed while the RLM alloy powder and the RH compound powder are present on the surface of the sintered R-T-B based magnet at a mass ratio of RLM alloy powder: RH compound powder=9.6:0.4 to 5:5.

2. The method for producing a sintered R-T-B based magnet of claim 1, wherein, on the surface of the sintered R-T-B based magnet, the RH that is contained in the RH compound powder has a mass of 0.03 to 0.35 mg per 1 $mm^2$ of the surface.

3. The method for producing a sintered R-T-B based magnet of claim 1, wherein the RH compound is the RH fluoride and/or the RH oxyfluoride.

* * * * *